United States Patent [19]

Gregory, Jr.

[11] 4,089,400

[45] May 16, 1978

[54] COIN TESTING DEVICE

[76] Inventor: Lester Gregory, Jr., 3845 1st Ave., St. Petersburg, Fla. 33713

[21] Appl. No.: 651,832

[22] Filed: Jan. 23, 1976

[51] Int. Cl.[2] ..... G07F 3/02

[52] U.S. Cl. ..... 194/97 A; 194/99

[58] Field of Search ..... 194/97 R, 97 A, 97 B, 194/99, 101, 102, DIG. 1, DIG. 3, 1 G, 1 M, 1 N; 133/8 R

[56] References Cited

U.S. PATENT DOCUMENTS

| | | | |
|---|---|---|---|
| 3,738,469 | 6/1973 | Prumm | 194/101 |
| 3,739,895 | 6/1973 | Fougere et al. | 194/100 A |
| 3,782,543 | 1/1974 | Martelli et al. | 209/111.7 X |
| 3,797,307 | 3/1974 | Johnston | 194/100 AX |
| 3,870,137 | 3/1974 | Fougere | 194/100 A |
| 3,921,003 | 11/1975 | Greene | 194/97 A X |

*Primary Examiner*—Robert B. Reeves
*Assistant Examiner*—Francis J. Bartuska
*Attorney, Agent, or Firm*—Dennis H. Lambert

[57] ABSTRACT

A coin testing device for discriminating between acceptable coins and unacceptable coins and slugs, includes an infeed chute along which coins are fed, and a plurality of light emitting and associated light sensitive devices associated with the chute for sensing various parameters, including the diameter, thickness and surface and edge configurations of coins, slugs and the like passing along the chute, and connected to control a coin deflector device for accepting acceptable coins and rejecting unacceptable coins, slugs and the like.

13 Claims, 27 Drawing Figures

FIG. 4.
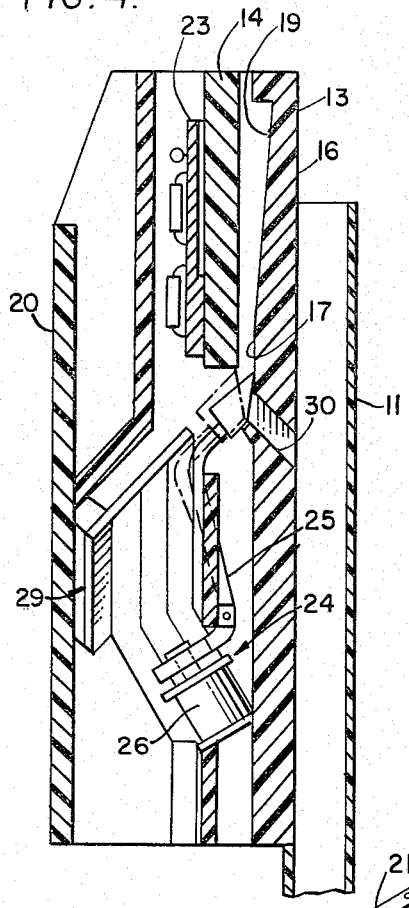
FIG. 5.
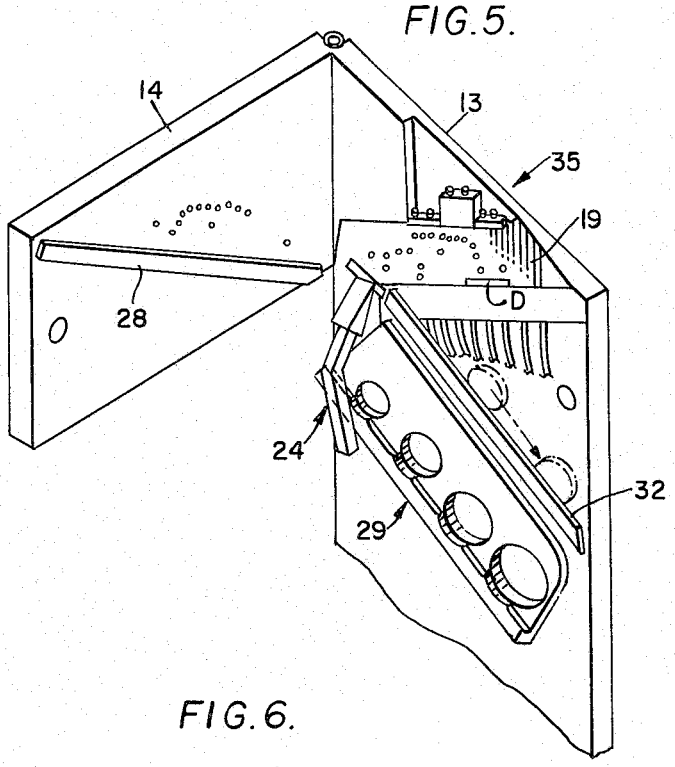
FIG. 6.
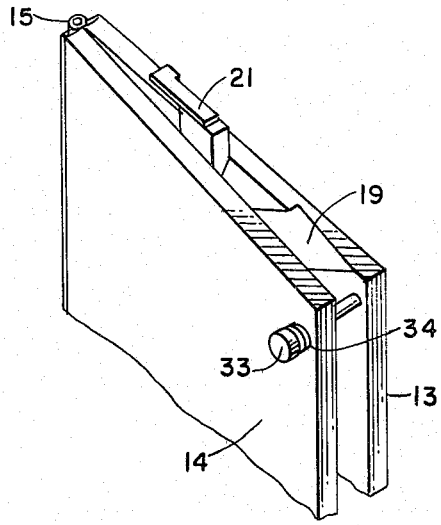
FIG. 7.
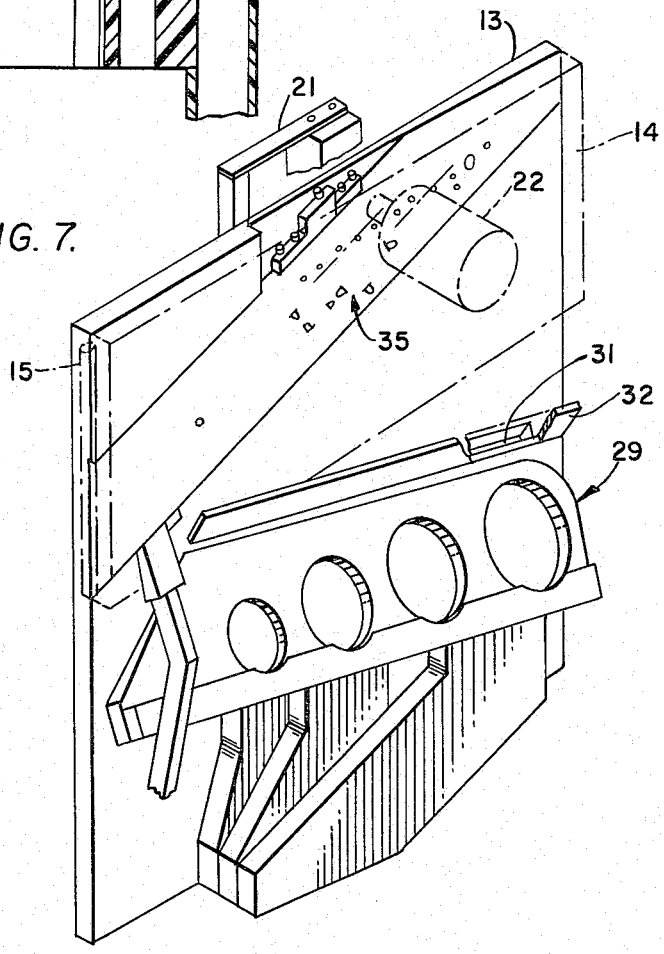
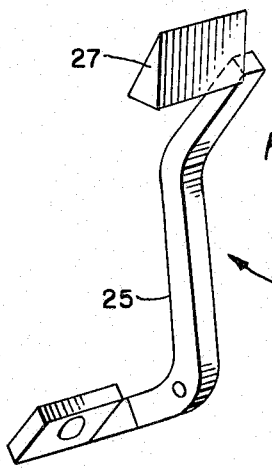
FIG. 8.

(ENERGIZED)

S11(NC)
S3
26
K11
VCC
67
555
(K10)
43
43a
69
(K10)
66
52
52a
76'
(K12)
S10
(NC)
S6
56
56a
80
K3
72
S12
(NC)
K2
S13
(NC)
S9
(NC)
S2
47
47a
Q5
46
45
46a
Q4
71
45a
Q6
73

VDD
VCC
IN
60
OUT
59
58
57
15 VOLT REG.
CD 4009 AE
88
96
CD 4013
84
85
86
CLOCK
RESET
Q
MAG.
1/4 CD 4011
555
COL. Q3
FROM RESET
27

VDD
14
1/4 CD 4011
13
12
A
89
11
CR1
R2
LED 1
VDD VCC
CD 4009 A5
CD 4000
97
1/4 CD 4011
8
9
B
10
11
CR2
R1
LED 2
90
91
98
1/4 CD 4011
1
2
C
3
CR3
R3
LED 3
633
87
PIN 15 OF 22
VCC
36
36a
61
COL. OF Q3
555
62
SOLENOID 26
Q5
VDD
1/2 CD 4013
CLOCK
RESET
93
COL.Q3
95
92

COIN TESTING DEVICE

BACKGROUND OF THE INVENTION

This invention relates generally to coin testing devices for discriminating between various coins and slugs and the like. More particularly, the present invention relates to a coin testing device for use with apparatus using coin-controlled energizing means, such as vending machines, pay telephones and the like. The coin testing device of the invention includes means for discriminating between acceptable coins and unacceptable coins and slugs and the like, and includes means for rejecting the unacceptable coins and slugs and the like.

The use of coin-operated and controlled devices is widespread, and includes such diverse mechanisms as pay telephones, coin-operated laundries, food vending machines, coin-operated car washes, and the like. Thus, it is readily apparent that enormous amounts of money pass through such machines, and the fact that they are generally left unattended makes them particularly susceptible to vandalism and fraudulent use. Accordingly, many different types of slugs have been developed for use in place of nickels, dimes and quarters and the like to operate such machines, with the resultant loss of large amounts of money to the owners and operators of such machines. Additionally, many foreign coins have substantially the same shape and size as domestic coins and can be used to obtain services or goods by effecting operation of coin-controlled means and without depositing the proper valuation of acceptable coins.

Moreover, many prior art coin testing devices include mechanical means which mechanically sense various parameters of coins and slugs and the like fed thereto to operate levers or switches and the like to either effect operation of the device or rejection of unacceptable coins and slugs or the like. The problem with such mechanically operated devices is that they are easily susceptible to jamming by the insertion of improper coins and slugs or the like, or by the introduction of foreign objects into the testing devices, as, for example, dirt or liquids and the like. Accordingly, with prior art devices frequent service calls are necessary in order to either remove jammed coins or slugs and the like from the mechanisms or to repair or clean the coin testing devices. This, obviously, increases the cost of operating and maintaining such devices, with a resultant increase in the costs of goods or services to the consumer.

With the present invention, a unique coin testing device is provided which effectively solves the problems found with prior art devices, and additionally, the coin testing device according to the present invention is less expensive to manufacture and maintain than prior art devices. More specifically, the coin testing device of the present invention includes a downwardly sloping coin infeed chute having a plurality of light emitting means and light sensitive means associated therewith and disposed to sense the presence of coins, slugs and the like passing along the chute to discriminate between acceptable coins and unacceptable coins and slugs and the like. Such light emitting and associated light sensitive means include means positioned to test the diameter, thickness and surface and edge configurations of coins, slugs and the like passing along the chute. The light emitting means and associated light sensitive means are connected in solid state circuit means for effecting operation of coin deflector means, to reject unacceptable coins and slugs and the like and to accept acceptable coins and the like, when they are fed to the device. Suitable, conventional means may be controlled by the device for effecting operation of a goods or service dispensing means or the like when acceptable coins are fed to the device.

OBJECTS OF THE INVENTION

Accordingly, it is an object of this invention to provide a coin testing device which is economically constructed and which includes a minimum of moving parts and which is exceptionally reliable and accurate in operation.

Another object of the invention is to provide a coin testing device which utilizes light sensitive means and light emitting means associated with a coin feed chute for testing coins and the like passing along the chute to operate appropriate electrical circuitry to accept coins and the like of acceptable value and to reject coins and slugs and the like of unacceptable value.

A still further object of the invention is to provide a coin testing device which may be readily inserted in or adapted to conventional, existing coin-operated mechanisms.

Yet another object is to provide a coin testing device which detects the thickness, diameter, magnetic property and surface and edge configurations of coins and slugs and the like fed thereto.

BRIEF DESCRIPTION OF THE DRAWINGS

FIG. 4 is a view in section taken along line 4—4 in FIG. 2.

FIG. 5 is a fragmentary, perspective view of the coin testing device of the invention, with the coin track or rail carrying portion thereof pivoted to a position away from the main body of the device.

FIG. 6 is a fragmentary, perspective view illustrating the manner in which a coin reject means operates to spread portions of the coin testing device apart to release a coin trapped therein.

FIG. 7 is a rear perspective view, with portions broken away, showing the coin chute and slot means of the device of the invention.

FIG. 8 is a perspective view of the coin reject bar used in the device of the invention.

FIG. 17 is a view in section taken along line 17—17 in FIG. 13 and is a view similar to FIG. 16 of a further testing means for the device of the invention, and shows a light sensitive means and light emitting means positioned to detect the presence of an annular lip or ridge on the periphery of an acceptable coin and the like.

FIG. 19 is an enlarged, fragmentary view in section showing an alternate arrangement of light emitting and light sensitive means for testing the serrations on the edge of a coin and the like.

DETAILED DESCRIPTION OF THE PRFERRED EMBODIMENT

Figure 1:
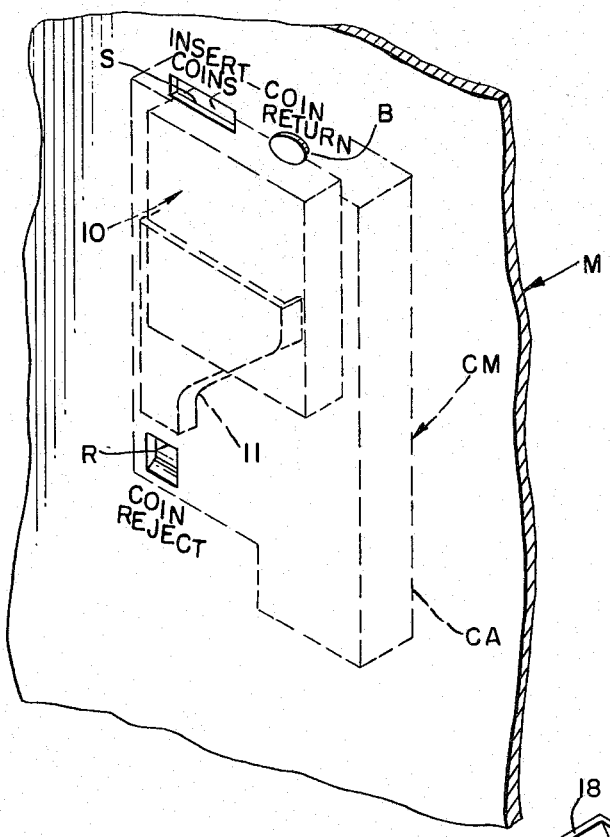
FIG. 1 is a fragmentary, perspective view of a portion of a mechanism operated by the insertion of coins and showing the coin testing device of the invention in dotted lines behind a wall of the mechanism.
Figure 2:
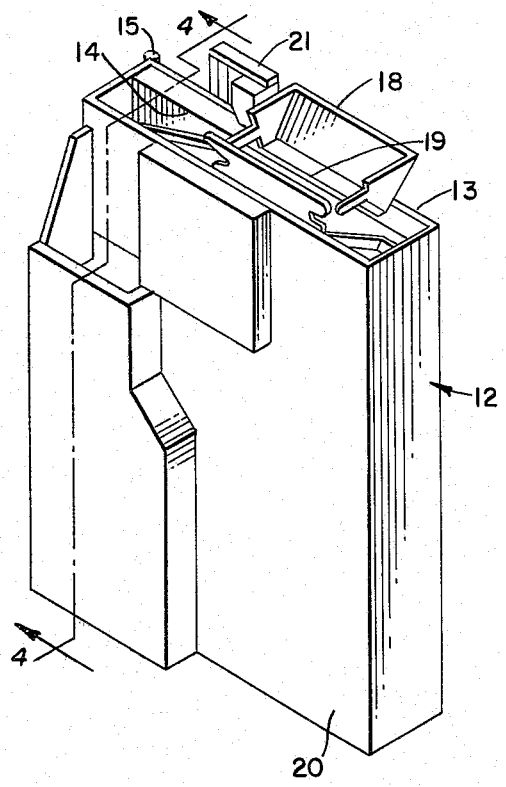
FIG. 2 is a rear perspective view of a coin testing device according to the invention.
Figure 3:
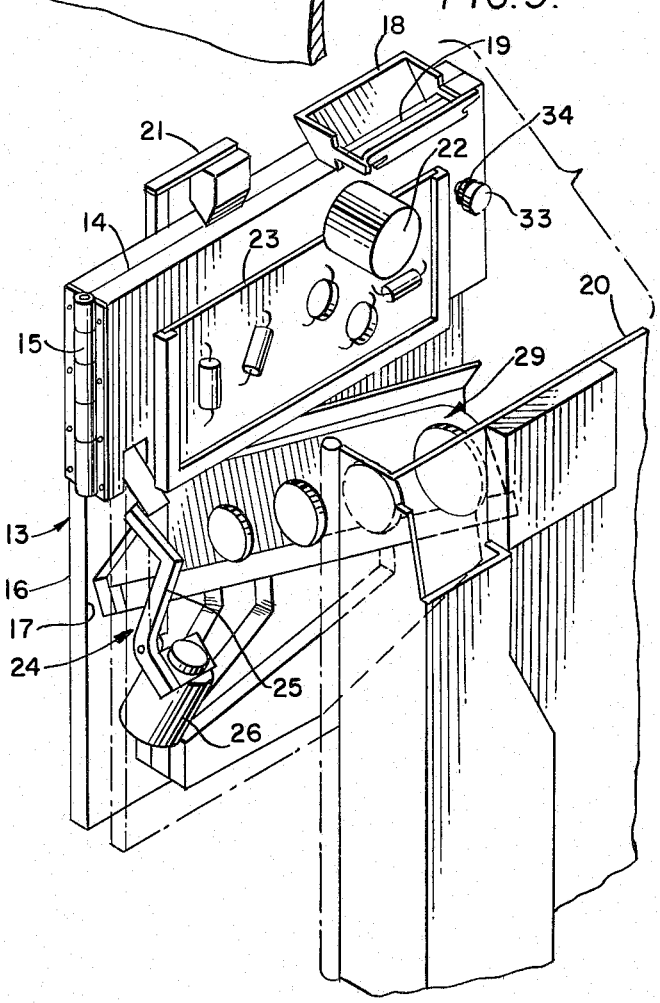
FIG. 3 is an exploded, perspective view, with portions removed, of the coin testing device of the invention.

In the drawings, wherein like reference numerals indicate like parts throughout the several views, a portion of a coin-activated mechanism or a machine, such as a vending machine or the like, is indicated generally at M, and a substantially conventional coin-controlled means CM is suitably supported in the machine M and is connected in a well-known and conventional manner with the machine to control operation of the dispensing of a goods or service or other means as desired.

The coin-controlled means CM includes a coin accumulator section CA at a lower portion thereof for accumulating coins of the proper value which are fed to the coin-controlled means CM through a coin insert slot S positioned immediately above the coin-controlled means CM. A coin testing device 10 in accordance with the invention is operatively associated with the coin-controlled means CM and is designed to be readily attached to existing, conventional coin-controlled means CM without requiring extensive modification thereof.

A coin return housing or cover 11 is operatively supported on the front of the coin testing device 10 for catching and guiding or conveying coins to a coin reject or return opening R in the front of the machine M. A coin return button B is also provided adjacent the top of the testing device 10 for releasing unacceptable coins and slugs and the like from the testing device 10 for return to the coin reject opening R.

The coin testing device 10 comprises a housing 12 having a substantially rectangularly shaped front plate 13 and a relatively smaller rectangularly shaped back plate 14 pivotally connected at one edge to one edge of the front plate by means of a hinge or the like 15. The front plate 13 has a front surface 16 and a rear surface 17, and the coin return cover 11 is suitably mounted to the front surface 16 of the front plate 13. A funnel-like coin guide means 18 is supported by the front plate 13 in a position in registry with the coin insert slot S, whereby coins inserted through the slot S will enter the guide 18 and thus be led into the upper end of a coin feed chute 19. A cover 20 is preferably suitably mounted to the housing at the rear surface thereof in covering relationship to the backplate 14 to protect the electrical components of the rejector and to enclose the coin dropout platform and chutes, and in general, to provide a neater, more compact appearance for the coin testing device.

The coin return button B operatively engages a wedge member 21 carried by the front plate 13 for urging the wedge member downwardly between the front plate and back plate 14 to spread them apart about the hinge 15, and thus release any coin or slug and the like held therebetween.

Normally, a change-making device is associated with coin-operated mechanisms such as that contemplated by the present invention, and a solenoid 22 is provided in the present invention, with a plunger thereof arranged to be extended across the chute 19 to block the introduction of a quarter along the chute in the event the change-making portion of the device is low or empty of change.

A printed circuit board 23 is also carried by the movable back plate 14, and a coin selector means or reject mechanism 24 includes a lever 25 operated by a solenoid 26 having its plunger associated with one end of the lever 25, and a coin deflect plate 27 at the other end of the lever 25 adapted to be disposed in a first, coin accept or feed position, as indicated in full lines in FIG. 4, when the solenoid 26 is energized, or a coin reject position when the solenoid is de-energized as indicated in dot and dash lines in FIG. 4.

A coin supporting track or rail 28 is carried by the back plate 14 in a position to be disposed at the lower edge of coin feed chute 19 when the back plate 14 is in its closed position contiguous with front plate 13 to support a coin rolling edgewise along the track in the chute 19, and a coin dropout chute 29 of the type illustrated and described, for example, in applicant's co-pending application Ser. No. 569,992 now U.S. Pat. No. 3,978,962, is provided at an oppositely sloping angle and below the coin feed chute 19 for a purpose as described in said co-pending application Ser. No. 569,992.

A drain opening D is provided near an upper end of the coin feed chute 19 for draining moisture and debris and the like from the coin feed chute upstream of the control means for coin discrimination. A coin reject slot or opening is formed through the front plate 13 at the lower end of coin feed chute 19, and the coin reject or deflector means 24 is operatively associated therewith for selectively deflecting coins therethrough when the deflect means 24 is in the position shown in phantom lines in FIG. 4.

A further coin reject opening 31 is formed through the front plate 13 at a location approximately beneath the inlet to the coin feed chute for deflection of unacceptable coins and slugs and the like into the cover or guide 11 for return to the coin reject opening R. For example, if a coin or slug and the like is detained in the chute, as by means of the plunger of the solenoid 22 in the event there is not sufficient change in the machine, or if the coin or the like is bent, or is similarly unacceptable, and operation of the wedge 21 is required to free the coin or the like from the chute, such coins drop onto the track defined by member 32 and roll along the member 32 to the slot 31, through which they drop for return to the opening R.

A pin 33 extends through the free edges of plates 13 and 14, and coil spring 34 is engaged therewith to resiliently urge the plates together during normal use.

More particularly, the coin testing or discriminating means of the present invention includes an array 35 of light emitting means and light sensitive means diposed in association with the coin feed chute 19 for sensing various parameters of a coin or the like moving along the chute. In a preferred form of the invention, the light emitting means comprise LEDs and the light sensitive means comprise phototransistors.

Figure 9:
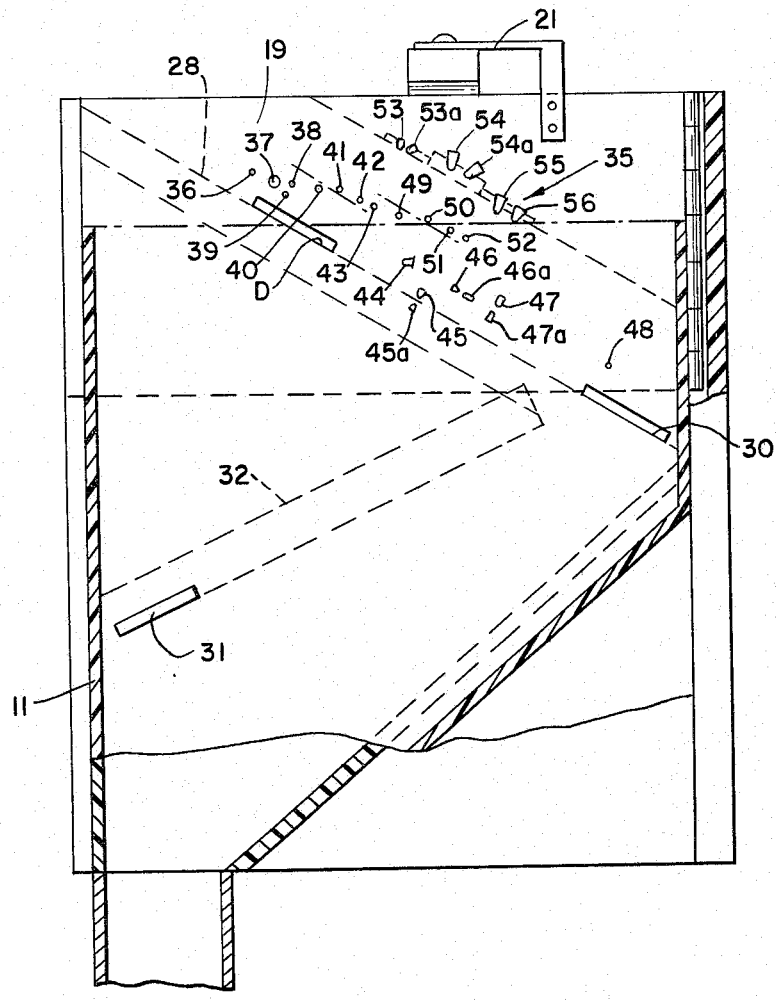
FIG. 9 is a view in section, with portions thereof broken away, looking toward the front of the device of FIG. 1, and showing the relative arrangement of coin reject slots, coin supporting tracks or rails and coin testing means along the chute.
Figure 10:
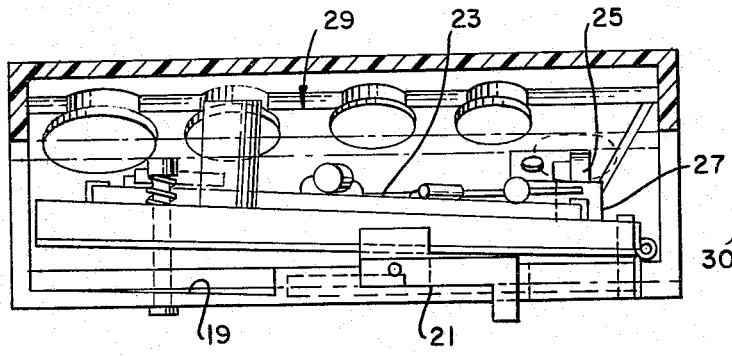
FIG. 10 is a plan view of the device of FIG. 1.
Figure 11:
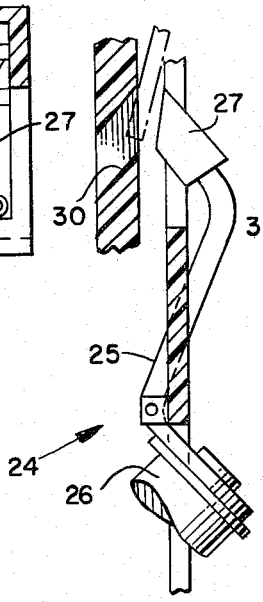
FIGS. 11 and 12 are enlarged, fragmentary views in section of a portion of the device of FIG. 1, showing in FIG. 11 the position of the coin deflector in a position to reject unacceptable coins and slugs and the like, and showing in FIG. 12 the position of the bar for passing acceptable coins on into the device.
Figure 12:
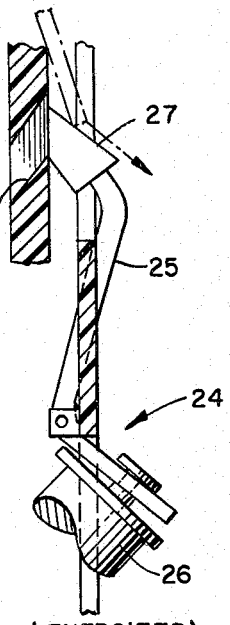
Figure 13:
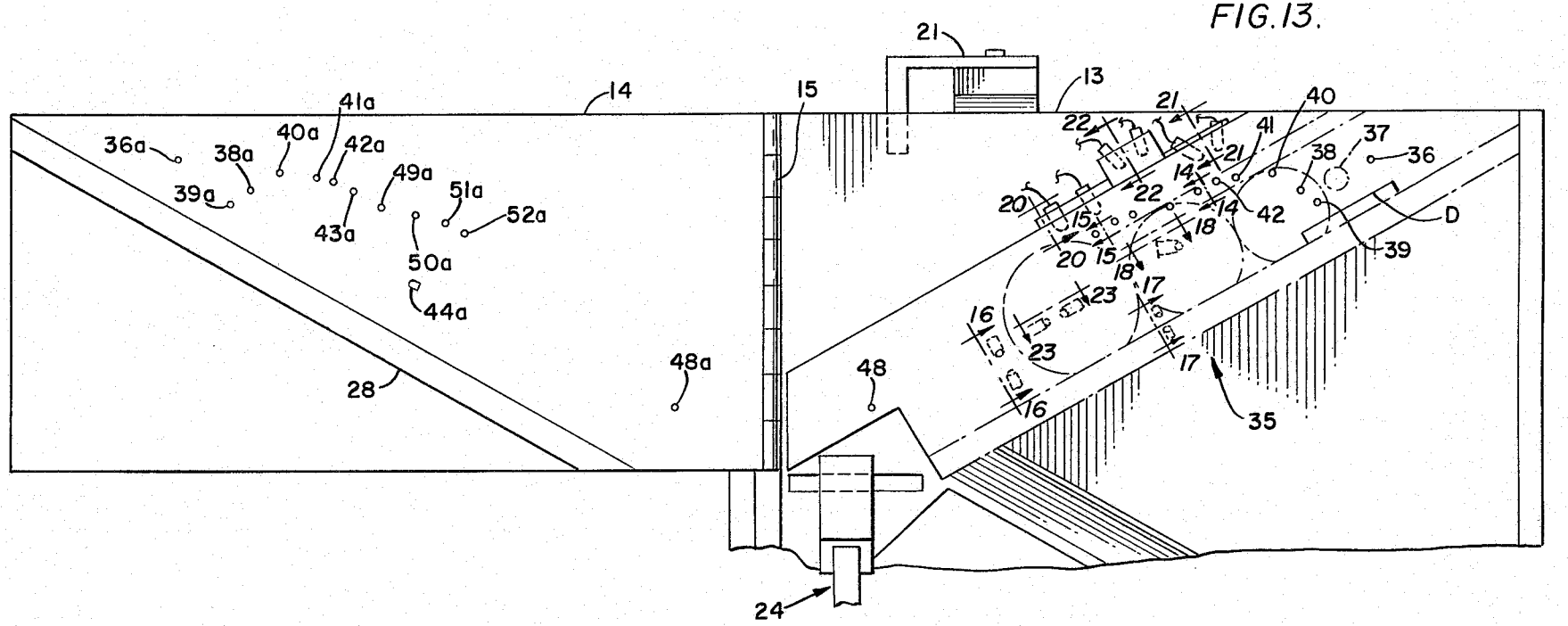
FIG. 13 is an enlarged view in elevation of the device of the invention, with the hinged back carrying the coin supporting rail of the coin feed chute shown in fully opened position exposing the coin testing means in the device.

Referring in particular to FIGS. 9 and 13, the array includes a first LED 36 and associated phototransistor **36*a* positioned nearest the entrance to the coin feed chute and disposed on opposite sides of the chute, whereby a coin or the like passing therebetween interrupts the light from the LED 36 to the phototransistor 36*a*. As described in more detail hereinafter, the LED 36 and phototransistor 36*a* are connected in a circuit such that only a signal of predetermined length will operate to energize the remainder of the control devices. In other words, the circuit includes means such that a pulse or signal must have a width at least as great as approximately ¾ the width or diameter of a dime in order to operate to energize the remainder of the circuit, and accordingly, a washer or slug and the like having a hole therethrough and moving along the chute will not produce a signal of long enough duration as it passes between the LED 36 and associated phototransistor 36*a*** to energize the remainder of the circuit.

An elecromagnet 37 is carried by the front plate 13 at one side of the chute 19 immediately following the LED 36, and a second LED 38 and associated phototransistor **38*a* are positioned on opposite sides of the chute immediately following the magnet 37 in a position to be intercepted by a coin or slug and the like moving along the chute, whereby a signal is produced and is connected in an electrical circuit to energize the electromagnet 37** and thus hold and detain a coin or slug and the like which has magnetic material in it.

A third LED 39 and associated phototransistor **39*a* are disposed on opposite sides of the chute adjacent the second LED and associated phototransistor, and are connected in the circuit such that only a pulse or signal of predetermined width will effect energization of subsequent devices in the circuit. Accordingly, if the coin or slug and the like includes magnetic material therein and is detained by the magnet 37 upon interrupting the light from LED 38 to phototransistor 38*a*, it will block the light from LED 39 to its associated phototransistor 39*a* for a predetermined length of time and thus produce an appropriate signal to open or break the circuit and thus prevent operation of the coin deflector means to the coin accept position. However, if the coin or slug and the like does not have magnetic material therein, it will continue down the chute and will not interrupt the light from LED 39 to phototransistor 39*a* for a sufficient length of time to produce the necessary signal to prevent operation of the coin selector. In other words, if the coin or slug and the like passes both the hole test performed by LED 36 and phototransistor 36*a* and the magnetic test performed by LED 39 and phototransistor 39*a***, the circuit remains in a ready state for performing other tests on the coin or slug and the like to ascertain its validity or acceptability, and to accept the coin if it passes all the tests.

Thus, a fourth LED 40 and associated phototransistor **40*a* are disposed on opposite sides of the chute spaced upwardly from the track 28 a distance just slightly less than the diameter of a dime, such that a dime or coin and the like rolling along the chute and having the same diameter as a dime will interrupt the light from LED 40 to phototransistor 40*a*** and produce an appropriate signal to energize other components in the circuit.

A fifth LED 41 and associated phototransistor **41*a* are positioned on opposite sides of the chute immediately following the LED 40 and spaced upwardly from the track 28 a distance slightly greater than the diameter of a dime, such that if the coin or the like is a dime or has the same diameter as a dime, it will not interrupt the light from LED 41 to phototransistor 41*a*, and the circuit will remain energized. However, if the coin or the like has a diameter larger than that of a dime, it will block the light from LED 41 to phototransistor 41*a*** and open the circuit.

Figure 14:
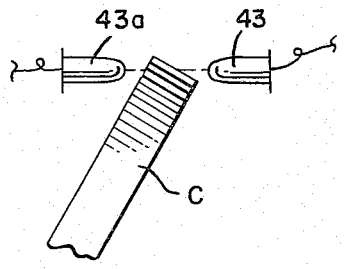
FIG. 14 is an enlarged, fragmentary view in section taken along line 14—14 in FIG. 13, showing the arrangement of light emitting means and light sensitive means relative to the coin feed chute for testing the thickness of a coin fed therealong, and as seen in this Figure, a coin of excessive thickness is illustrated and such a coin blocks the light passing across the chute to give an appropriate signal indicating that the coin is unacceptable.
Figure 15:
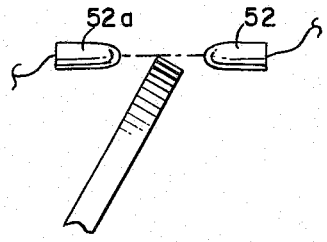
FIG. 15 is a view in section taken along line 15—15 in FIG. 13 and is a view similar to FIG. 14, showing a coin of acceptable thickness moving along the chute.

A sixth LED 42 and associated phototransistor **42*a* are disposed on opposite sides of the chute immediately following the fifth LED 41 and spaced upwardly from the track 28 and angled across the chute, as depicted in FIG. 14**, so as to measure the thickness of the coin. Thus, if the coin or slug and the like has the same or greater thickness than a dime, the light to 42*a* is interrupted, producing a signal whereby the circuit is energized and in a ready state, and if the coin and the like is thinner than a dime, it will not block the light from LED 42 to phototransistor **42*a***, and thus other portions of the circuit will not be energized, or placed in a ready state, as described hereinafter, and the coin will not be accepted, even though it passes other tests.

Thereafter, the coin passes between a seventh LED 43 and associated phototransistor 43a positioned on opposite sides of the chute and angularly disposed, as in FIG. 14, to measure the thickness of the coin and the like, and if the coin and the like has a thickness greater than that of a dime, it will block the light, as shown in FIG. 14, thus producing a signal to open the circuit and prevent acceptance of the coin or the like unless other tests subsequently performed by the device indicate acceptance thereof. On the other hand, if the coin or the like does not have a thickness greater than that of a dime, it will not block the light from LED 43 to phototransistor 43a and the circuit will not be opened or reset.

A still further LED 44 and associated phototransistor 44a are disposed on opposite sides of the chute following the thickness testing LEDs 42 and 43, and the LED 44 and phototransistor 44a are aimed to converge at a point in the path of advancement of a dime moving along the chute to intercept the leading edge of the dime and detect the presence of serrations thereon. In other words, if the coin or the like is a dime and has proper serrations on the peripheral edge thereof, the light from LED 44 is diffused or scattered and not enough light is reflected to phototransistor 44a to produce a signal, and the circuit remains in a set or ready state. On the other hand, if the coin or the like has a smooth, shiny peripheral edge surface, light from LED 44 will be reflected to phototransistor 44a, producing a signal and resetting the circuit.

Figure 17:
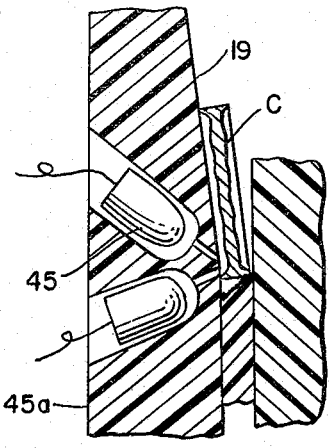

Following the serration test, the coin moves past an LED 45 and associated phototransistor 45a positioned at the lowermost edge of chute 19 adjacent the track 28 and angularly disposed, as illustrated in FIG. 17, such that if the coin or the like has a peripheral lip thereon of the proper configuration and size, light is not reflected from LED 45 to phototransistor 45a, and thus no signal change is produced, and the circuit remains in a set or ready state to accept the coin if the other tests are passed. On the other hand, if the coin or slug and the like has a larger lip than is present on U.S. coins, light is reflected to 45a, producing a signal and opening or resetting the circuit so that the coin or slug and the like cannot be accepted.

Figure 23:
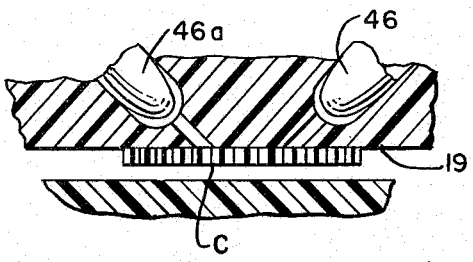
FIG. 23 is a view in section taken along line 23—23 in FIG. 13, and shows an arrangement of light emitting means and light sensitive means disposed along an axis at 90° to the axis of the means in FIG. 16 and is provided for detecting the extent of the depth of indentations on the face of a coin or the like moving along the chute.

Following the lip test performed by LED 45 and phototransistor 45a, the coin passes an LED 46 and associated phototransistor 46a angularly positioned at one side of the chute, as seen in FIGS. 9 and 23, to test the width and depth of indentations in the face configuration of the coin and to produce a reflection and associated signal if the indentations are wider and deeper than those on an acceptable U.S. coin. In other words, while some foreign coins, for example, may have the same diameter and thickness and edge configuration as some U.S. coins, the configuration on the faces thereof will have wider and deeper indentations. Thus, the signal produced by this test will eliminate or effect rejection of such foreign coins or slugs and the like. An acceptable U.S. coin, on the other hand, will not produce or cause a reflection of light and associated signal when it passes LED 46 and associated phototransistor 46a.

Figure 16:
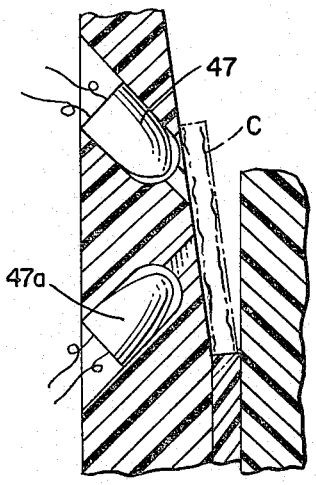
FIG. 16 is an enlarged, fragmentary view in section taken along line 16—16 in FIG. 13, showing a further coin testing means according to the invention, wherein a light emitting means and light sensitive means are positioned at one side of the coin feed chute for obtaining a reflection of light from the side of an acceptable coin.

After this test, the coin or the like passes a further LED 47 and associated phototransistor 47a angularly disposed along axes lying in a plane substantially perpendicular to the axis of the coin feed chute, as seen in FIGS. 9 and 16, and positioned such that light will be reflected from the face of an acceptable coin to thereby produce an appropriate signal to set or energize other portions of the circuit. On the other hand, a coin or slug and the like which has a smooth face or only very shallow indentations therein will not cause reflection of light in an amount sufficient to produce an appropriate signal to set or energize other portions of the circuit and thus such coin or slug and the like will be rejected.

The coin face configuration test described immediately above is the last test performed on a coin or the like rolling down the chute, and once the coin or the like moves past this test, it is either accepted or rejected, depending upon the results of the various tests performed. Thus, the coin will either be guided into the coin dropout chute 29 or deflected through the reject opening 30, by appropriate operation of the coin reject mechanism 24, as more fully explained hereinafter.

A reset LED 48 and associated phototransistor 48a are disposed on opposite sides of the chute in an area adjacent the reject opening 30 in a position to be in the path of advancement of any coin or slug and the like rolling along the chute, whereby light from LED 48 to phototransistor 48a is interrupted and an appropriate signal produced to reset the complete circuit and place it in readiness for a subsequent coin or slug and the like fed to the chute.

A similar arrangement of LEDs 49, 50, 51 and 52 and associated phototransistors 49a, 50a, 51a and 52a are disposed on opposite sides of the chute following the seventh LED 43 for measuring the diameter and thickness of a nickel moving through the chute. In other words, LED 49 and its associated phototransistor are positioned upwardly from the rail 28 a distance just slightly less than the diameter of a nickel, whereby a coin or slug and the like having a diameter at least as great as a nickel will block the light from LED 49 to phototransistor 49a, whereas a coin or slug and the like having a diameter smaller than that of a nickel will not block the light.

Likewise, LED 50 and its associated phototransistor 50a are positioned or spaced from the rail a distance slightly greater than the diameter of a nickel, and LEDs 51 and 52 and their associated phototransistors are angularly arranged relative to the chute similarly to LEDs 42 and 43 and their associated phototransistors for measuring the thickness of a nickel and for effecting energization or setting and resetting of the circuit, just as previously described for a dime passing along the chute.

The nickel or the like will also be subjected to the tests performed by LEDs 44, 45, 46 and 47 and their associated phototransistors, such that only acceptable coins will be guided to the coin dropout chute 29.

A quarter or similar coin or slug and the like is tested for serrations on its marginal edge by an LED 53 and associated phototransistor 53a disposed at the top of the chute 19 adjacent the inlet end thereof and arranged such that a quarter or the like having serrations on the edge thereof will reflect light from LED 53 to phototransistor 53a to produce an appropriate signal and set or energize the circuit, as described in greater detail hereinafter.

Another LED 54 and associated phototransistor 54a are provided following LED 53 and its phototransistor and are arranged to obtain a reflection from a coin or the like having a smooth outer marginal edge, and thus produce a signal to open the circuit, but an acceptable coin, such as a quarter with serrations on the edge thereof, will not reflect sufficient light to produce a signal, and thus the circuit will remain energized.

Following the quarter serrations tests, an LED 55 and associated phototransistor 55a are angularly positioned on opposite sides of the chute for measuring the thickness and diameter of a quarter and the like, and if the coin has the same diameter and thickness as a quarter, it will interrupt light from LED 55 to phototransistor 55a and produce an appropriate signal to energize predetermined portions of the circuit. Alternatively, if the coin and the like is thinner than a quarter, it will not block the light, and thus the necessary signal will not be produced to energize other portions of the circuit to effect acceptance of the coin.

A further diameter and thickness testing LED 56 and associated phototransistor 56a follow the LED 55 and its phototransistor and are arranged such that a quarter or the like having the proper thickness and diameter will not interrupt the light from LED 56 to its phototransistor, and thus a signal will not be produced and the circuit will remain in a ready state to accept the coin. On the other hand, if the coin has a greater diameter or thickness than a quarter, it will interrupt light from LED 56 to its phototransistor, thus producing a signal which is utilized to reset or open the circuit and effect rejection of the coin or slug and the like. Of course, a coin or slug and the like having a diameter as large as a quarter will interrupt most of the LEDs and associated phototransistors positioned along the chute, first producing set signals and then producing reset or circuit opening signals.

The hole test, magnetic test, lip test and face configuration tests are performed by the same LEDs and associated phototransistors on all coins or slugs and the like moving along the chute. Also, light from the LED 48 to its associated phototransistor is interrupted by all coins or slugs and the like moving along the chute to reset the entire circuit.

Figure 19:
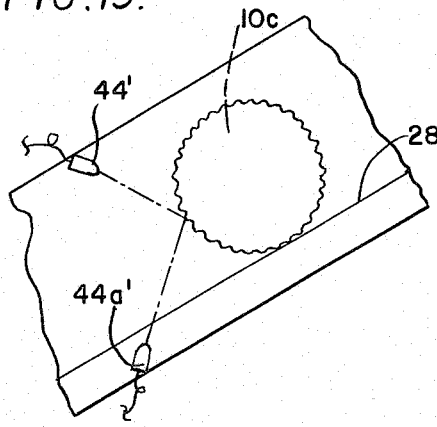
Figure 21:
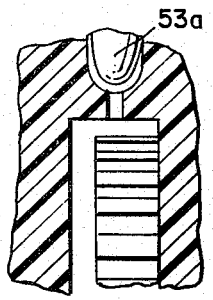
FIG. 21 is a view in section taken along line 21—21 in FIG. 13, and shows serration testing means for testing the serrations on the edge of a quarter and the like, and a signal is produced if serrations are present.
Figure 20:
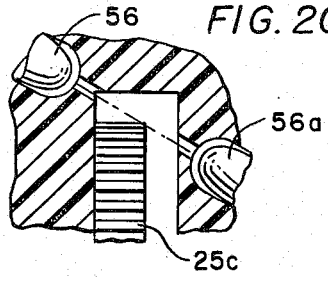
FIG. 20 is a view in section taken along line 20—20 of FIG. 13 and shows the arrangement of light emitting means and light sensitive means for testing the diameter and thickness of a quarter and the like moving along the chute, and in this figure, shows a quarter of correct diameter and thickness.
Figure 18:
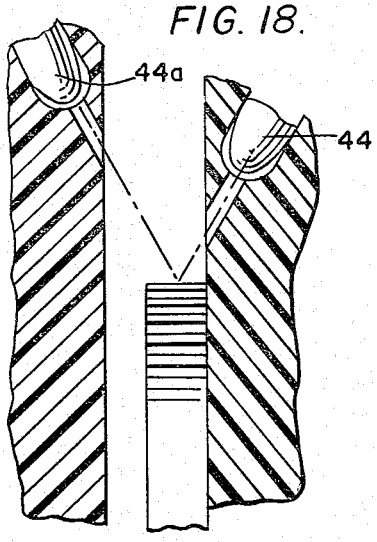
FIG. 18 is an enlarged, fragmentary view in section taken along line 18—18 in FIG. 13 of a further testing means for the invention, and shows a light emitting means and light sensitive means positioned to detect serrations on the marginal edge of a coin or the like passing along the chute.
Figure 22:
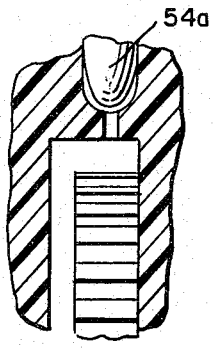
FIG. 22 is a view taken along line 22—22 in FIG. 13, of serration testing means, and if serrations are present, no reflection signal is produced, but a smooth surface reflects and causes a signal.

In FIG. 19, an alternate arrangement of light emitting means and associated light sensitive means are illustrated for testing the serrations on the edge of a dime or the like, and instead of being aimed or focused diagonally across the chute, the light emitting means and light sensitive means are positioned near the top and bottom of the chute, respectively, in a position to detect the presence or absence of serrations on the edge of the dime or the like moving along the chute.

Figure 24:
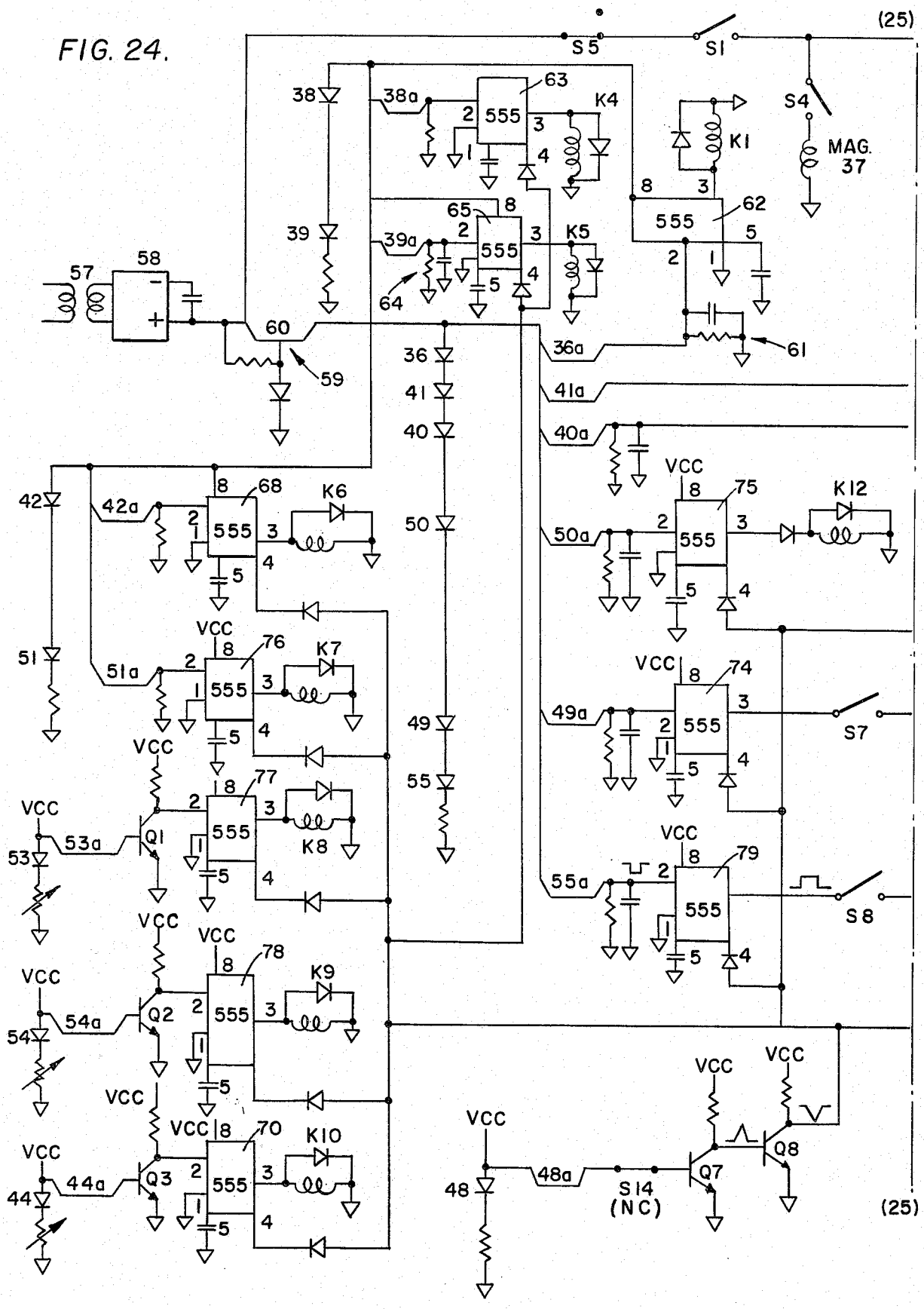
FIGS. 24 and 25 are schematic diagrams of a first form of circuit used in the device of the invention.
Figure 25:
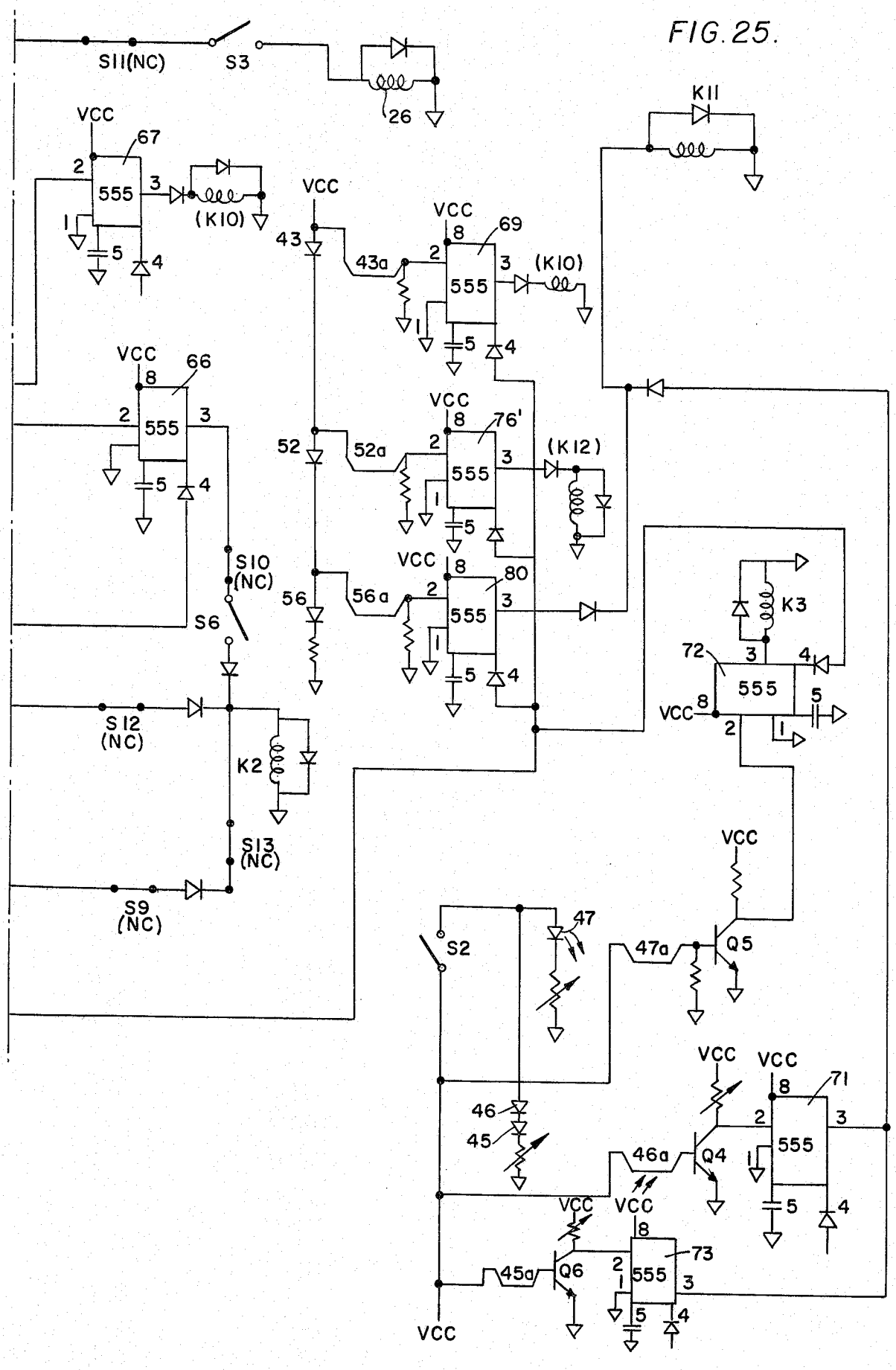

A first circuit for use with the coin testing device of the invention is illustrated schematically in FIGS. 24 and 25, and includes a transformer 57 for stepping the line voltage down from 110 volts ac to 12 volts ac, or any other voltage desired or necessary, depending upon the particular application for the invention. For example, if the coin testing device of the invention is intended to be used in a pay telephone or other low voltage device, then the transformer would be appropriately designed to obtain the desired voltage.

A bridge rectifier 58 converts the alternating current to direct current and supplies it to a line voltage regulator 59, which includes a power transistor 60. The reduced, rectified and regulated power is then supplied to the array of light emitting means and light sensitive means comprising the LEDs and phototransistors described hereinabove.

The hole testing LED 36 and associated phototransistor 36a are connected through an RC timing network 61 with the clock input pin 2 to 555 timer chip 62, and when a coin passing down the chute moves between LED 36 and phototransistor 36a, light is blocked from the phototransistor, causing it to go negative and producing a pulse through the timing network 61 to input pin 2 of timer 62. The pulse will have a duration equivalent to the diameter of the portion of the coin passing between the LED and phototransistor, and if the duration of the pulse is long enough as determined by the timing network 61, the timer 62 will be turned on, producing an output at pin 3 and energizing solenoid K1, closing switch S1 and thus supplying positive voltage to one side of the contact points of switches S3 and S4.

Assuming the coin is a dime, it then continues down the chute and passes between LED 38 and its phototransistor 38a, blocking the light from phototransistor 38a and causing it to go negative, sending a signal to input pin 2 of 555 timer chip 63, turning the timer on, causing an output from pin 3 thereof, energizing solenoid K4, closing the contacts of switch S4, and thus applying voltage to the magnet 37, energizing the magnet and causing the coin to be detained thereat if the coin or slug has magnetic material therein. If the coin or slug is magnetic and is detained by the magnet 37, it blocks light from LED 39 to phototransistor 39a, causing it to go negative and producing a pulse, which is sent through the RC timing network 64 to input pin 2 of 555 timer chip 65, turning it on and producing an output at pin 3 which energizes solenoid K5, opening the contact points of switch S5, thereby terminating voltage to the magnet 37 and releasing the coin or slug and the like, permitting it to continue rolling down the chute.

As noted previously, the coin reject mechanism 24 includes a lever operated by a solenoid 26 to move a coin deflecting member into and out of coin accept or coin reject positions, and when the solenoid 26 is energized, the lever is moved to place the coin deflect member in a position whereby acceptable coins and the like are gathered and deflected onto the coin dropout chute or platform 29, and when the solenoid is de-energized, the lever stays in a position with the coin deflecting member disposed to deflect coins or slugs and the like through the reject opening 30. Thus, with the circuit in the state as described immediately hereinabove, with the contacts of switch S5 open, no voltage can be supplied to coil or solenoid 26, regardless of what other portions of the circuit may be energized or set as the coin continues to move down the chute.

When the magnetic coin or slug and the like passes LED 48 and its phototransistor 48a, light is blocked to the phototransistor, causing it to go negative, supplying a negative signal to the base of transistor Q7, causing the collector of the transistor to go positive and placing a positive signal on the base of transistor Q8, causing the collector of this transistor to go negative, and this negative signal is supplied through a diode to the reset pins 4 of each of the timers 63 and 65, resetting them and thus removing the positive voltage from coins or solenoids K4 and K5, enabling the contacts of switch S5 to close and opening the contacts of switch S4.

On the other hand, assuming that the coin is a dime and is thus not magnetic, it will not block the light from LED 39 to phototransistor 39a for a period of time sufficient to turn on the timer 65, due to the time constant of RC network 64. Thus, the coil K5 is not energized and the contacts of switch S5 remain closed. The dime then passes between LED 40 and phototransistor 40a, and since it has the proper diameter, it blocks the light to phototransistor 40a, causing it to go negative and applying a signal to input pin 2 of 555 timer 66, turning it on and applying a positive voltage from output pin 3 to the contacts of switch S6. Anything having a diameter smaller than that of a dime will not block light to phototransistor 40a, and will therefore not turn the timer 66 on and will not apply voltage to the contacts of switch S6. The dime then rolls past LED 41 and phototransistor 41a, but because of its small diameter, does not block the light to phototransistor 41a, and thus timer 67 is not turned on. However, if the coin has a diameter larger than that of a dime, phototransistor 41a will go negative, applying a negative signal to input pin 2 of timer 67, turning it on and producing a positive output at pin 3, enerizing solenoid K10 and opening the contacts of switch S10, thus removing the voltage from the contacts of switch S6. The coin then rolls between LED 42 and phototransistor 42a, and if it is of the proper thickness, it blocks light to phototransistor 42a, causing 42a to go negative and applying a negative signal to input pin 2 to 555 timer 68, producing a positive output at pin 3, energizing solenoid K6 and closing the contacts of switch S6, thereby applying a positive voltage to coil K2, energizing it and closing the contact points of switch S2, thereby applying a positive voltage to LED 47 and turning it on. Anything thinner than a dime will, of course, not block the light to phototransistor 42a, and timer 68 will therefore not turn on and coil K6 will not be energized, and thus the contacts of switch S6 will not be closed, and similarly, coil K2 will not be energized and the contacts of switch S2 will not be closed, and LED 47 will thus not be turned on, and the coin thus cannot be accepted.

Thereafter, the coin rolls past LED 43 and phototransistor 43a, and if it is a dime and is of the proper thickness, it will not block light to phototransistor 43a and no signal will be produced. However, if the coin has a thickness greater than that of a dime, it will block the light to phototransistor 43a, causing it to go negative and applying a negative signal to input pin 2 of timer 69, producing a positive output at pin 3, which energizes coil K10 and opens the contacts of switch S10, thus removing voltage from the contacts of switches S6 and S2 and turning off LED 47. However, a dime of the correct diameter and thickness will continue rolling down the chute, past LED 44 and phototransistor 44a, and if the dime has the proper serrations on the marginal edge thereof, the light is broken up, so that 44a does not receive enough light to produce a signal of the proper threshold to turn on transistor Q3, and thus timer 70 will not be turned on, and coil K10 will remain de-energized and the contacts of switch S10 will remain closed. On the other hand, if there are no serrations on the coin, a strong reflection is sent to phototransistor 44a, causing it to go positive and making the collector of transistor Q3 go negative, sending this signal to input pin 2 of timer 70, turning it on and applying a positive voltage from pin 3 to coil K10, thereby opening the contacts of switch S10 and removing the voltage from switches S6 and S2 and turning off LED 47. The coin then rolls past LED 46 and phototransistor 46a, and if the coin or slug has wider and deeper indentations on its face than any U.S. coin, light is reflected to phototransistor 46a, causing it to apply the threshold voltage to transistor Q4, making its collector go negative and applying a negative signal to input pin 2 of timer 71, thereby producing a positive output at pin 3, which turns on coil K11 and opens the contacts of switch S11, whereby the coin or solenoid 26 cannot be energized into the coin accept position. The coin then rolls past LED 47 and phototransistor 47a, and if the coin has indentations on the face thereof, light is reflected to the phototransistor 47a, causing it to apply the threshold voltage to transistor Q5, thereby making its collector go negative and applying a negative signal to input pin 2 of timer 72 and applying a positive output at pin 3, energizing coil K3 and closing the contacts of switch S3. However, inasmuch as the contacts of switch S11 are open, the coil 26 cannot be energized and the coin will be deflected through the reject opening 30. On the other hand, if the coin had been an acceptable coin, such as a dime or the like, the contacts of switch S11 would have remained closed and the closing of the contacts of switch S3 would thereby have energized coil 26, moving the coin deflect mechanism into a position to deflect the coin onto the coin dropout chute 29.

Moreover, if the coin or slug and the like does not have indentations on the face or faces thereof, then not enough light will be reflected to turn on timer 72, and the contacts of switch S3 will thus not be closed, and the coin deflect mechanism will remain in the reject position.

In addition to the above tests, the coin will roll past LED 45 and phototransistor 45a, and if a lip of the proper dimension is present, as on U.S. coins, the light is not reflected from LED 45 to phototransistor 45a and no signal change is obtained, and transistor Q6 is thus not turned on, and thus timer 73 is not turned on, whereby the coil K11 is not energized and the contacts of switch S11 will remain closed. However, if there is a lip of excessive size on the coin or slug and the like, as sometimes found on foreign coins or slugs and the like, light is reflected to phototransistor 45a, turning on transistor Q6 and applying a negative signal to pin 2 of timer 73, which produces a positive output at pin 3, which is supplied to coil K11, energizing it and opening the contacts of switch S11, whereby the coil 26 of the coin reject mechanism cannot be energized and the coin or slug and the like will thus be deflected through the reject opening 30.

As the coin or slug and the like reaches the coin reject mechanism, it passes between LED 48 and phototransistor 48a, blocking light to phototransistor 48a, thus applying a negative voltage to the base of transistor Q7, causing its collector to go positive and applying this signal to the base of transistor Q8, causing its collector to go negative, which signal is applied to the reset pins 4 of all of the 555 timers, thus resetting them and placing the circuit in readiness for a subsequent coin or slug and the like fed to the chute 19.

Similar results are obtained when a nickel is fed to the coin chute 19. Thus, a nickel rolls down the chute and blocks the light from LED 36 to phototransistor 36a, and operates to turn on timer 62 just as a dime, and closing the contacts of switch S1. The nickel then passes between LED 38 and phototransistor 38a, again operating on the circuit just as a dime and turning on the magnet 37. If the nickel is not magnetic, it, of course, proceeds on down the chute, and if magnetic, the same results are obtained as with a dime. The nickel will, of course, block light from LED 40 to phototransistor 40a and apply voltage to the contacts of switch S6. Because of its large diameter, it also will block light from LED 41 to phototransistor 41a, turning on timer 67 and opening the contacts of switch S10, thereby removing the voltage from the contacts of switch S6. The nickel will also block light from LED 42 to phototransistor 42a, turning on timer 68 and energizing coil K6 and closing the contacts of switch S6. However, since the contacts of switch S10 are open, no voltage can be applied to coil K2, with the result that switch S2 remains open and LED 47 cannot be turned on. Further due to its large diameter, the nickel will block light from LED 43 to phototransistor 43*a*, thus turning on timer 69 and applying voltage to coil K10, opening or tending to open the contacts of switch S10, with the result described immediately above.

LEDs 49, 50, 51 and 52 and associated phototransistors 49*a*, 50*a*, 51*a* and 52*a* are connected in the circuit to perform the same functions performed by LEDs 40, 41, 42 and 43 and their associated phototransistors, respectively. In other words, if the coin has a diameter of at least as great as that of a nickel, it will block light from LED 49 to phototransistor 49*a*, turning on timer 74 and applying a positive voltage to the contacts of switch S7, and if the coin or the like does not have a diameter greater than that of a nickel, it will not block light from LED 50 to phototransistor 50*a*, and timer 75 will thus not be turned on, with the result that the coil K12 will not energized and the contacts of switch S12 will remain closed. On the other hand, if the coin has a diameter greater than that of a nickel, it will block the light from LED 50 to phototransistor 50*a*, with the result that timer 75 will be turned on, applying a positive voltage to coil K12, thus opening the contacts of switch S12 and preventing voltage from being applied to K2 and thereby LED 47 cannot be turned on. Assuming the coin has the diameter of a nickel, it will then pass LED 51 and its associated phototransistor 51*a*, and if it is of the proper thickness, it will block light to phototransistor 51*a*, turning on timer 76 and applying a positive voltage to coil K7, thus closing the contacts of switch S7 and applying voltage to coil K2, closing the contacts of switch S2 and turning on LED 47. Thereafter, the coin will pass LED 52 and its associated phototransistor 52*a*, and if it is of the correct thickness for a nickel, it will not block the light to phototransistor 52*a*, and timer 76 will thus not be turned on, with the result that coil K12 will not be energized and voltage will continue to be applied to coil K2, with the result that the contacts of switch S2 remains closed and LED 47 remains turned on. However, if the coin has a thickness greater than that of a nickel, light will be blocked to phototransistor 52*a*, turning on timer 76 and energizing coil K12, thus opening the contacts of switch S12 and removing the voltage from coil K2, enabling the contacts of switch S2 to open and turning off LED 47.

The nickel is subject to the remaining tests for the presence of a lip and for the surface or face configuration by LEDs 45, 46, 47 and their associated phototransistors just as for a dime.

A quarter or coin or slug of like dimensions supplied to the chute 19 will, of course, block light from all of the LEDs 36, 38-43 and 49-52 to their associated phototransistors, producing the same results as described hereinabove and will, additionally, be subjected to the lip test performed by LED 45 and phototransistor 45*a* and the surface configuration tests performed by LEDs 46 and 47 and their associated phototransistors 46*a* and 47*a*, respectively.

Further the LED 53 and associated phototransistor 53*a* adjacent the top of the chute 19 are aimed to detect the presence of serrations on the peripheral edge of the quarter or the like, and if serrations are present, a reflection of sufficient intensity is received by the phototransistor 53*a* to make it go positive and apply the threshold voltage to the base of transistor Q1, causing the collector thereof to go negative, thus applying a negative signal to input pin 2 of timer 77, producing an output at pin 3 and energizing coil K8, thus closing the contact points of switch S8. The coin also passes beneath LED 54 and phototransistor 54*a*, which are positioned such that not enough reflection will be obtained if serrations are present to cause phototransistor 54*a* to apply the threshold voltage to transistor Q2, and thus timer 78 will not be turned on and coil K9 will not be energized and the contacts of switch S9 will thus remain closed. However, if no serrations are present, a strong reflection will be received by phototransistor 54*a*, with the result that the collector of transistor Q2 will go negative, turning on timer 78 and applying voltage to coil K9, opening the contacts of switch S9. Voltage can thus not be applied to coil K2 and LED 47 can thus not be turned on. The coin next passes beneath LED 55 and its associated phototransistor 55*a*, and if it is of the proper thickness, light is blocked to phototransistor 55*a*, with the result that it goes negative, applying a negative signal to input pin 2 of timer 79, turning on the timer and producing a positive output voltage at pin 3, which is conducted via the closed contacts of switches S8 and S9 to coil K2, energizing the coil and closing the contacts of switch S2, thereby turning on LED 47. Similarly, the coin passes beneath LED 56 and associated phototransistor 56*a*, and if it is of the proper thickness for a quarter, it does not block the light to phototransistor 56*a*, and the timer 80 is thus not turned on. However, if the coin is of a thickness in excess of the thickness of a quarter, it will block the light to phototransistor 56*a*, with the result that a negative input is supplied to input pin 2 of timer 80, and a positive output is obtained at pin 3, which is supplied to coil K11, thus opening the contacts of switch S11 and disabling the solenoid or coil 26, whereby any such coin or slug or the like will be deflected through the reject opening 30

The quarter is also subjected to the surface configuration tests and lip test as performed on a dime and nickel.

The vending box or other device with which the apparatus of the present invention is associated may have conventional means associated therewith for sensing the presence or absence of change in the device, such that when there is inadequate change, a relay is operated to open the contacts of switch S13 to thus prevent operation of the device when a quarter is supplied to the chute 19. Similarly, a conventional means is in the vending box or other apparatus with which the device of the invention is used and is operative to open the contacts of switch S14 when the machine or other device is in the vending process or the like. When the contacts of switch S14 are open, all of the 555 timers are reset, and they remain that way until the vending process or the like is completed.

Figure 26:
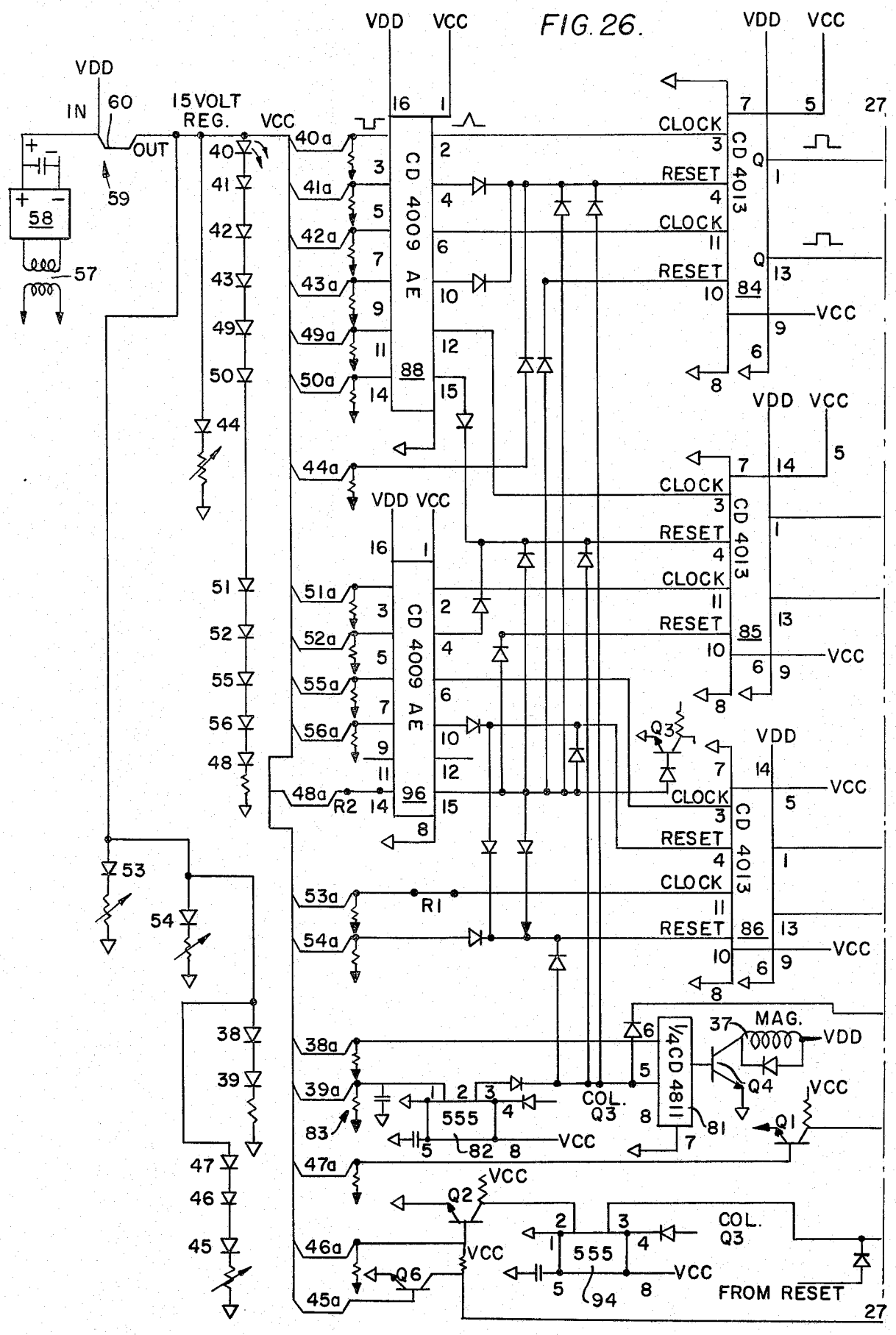
FIGS. 26 and 27 are schematic diagrams of a second form of circuit used in the device of the invention.
Figure 27:
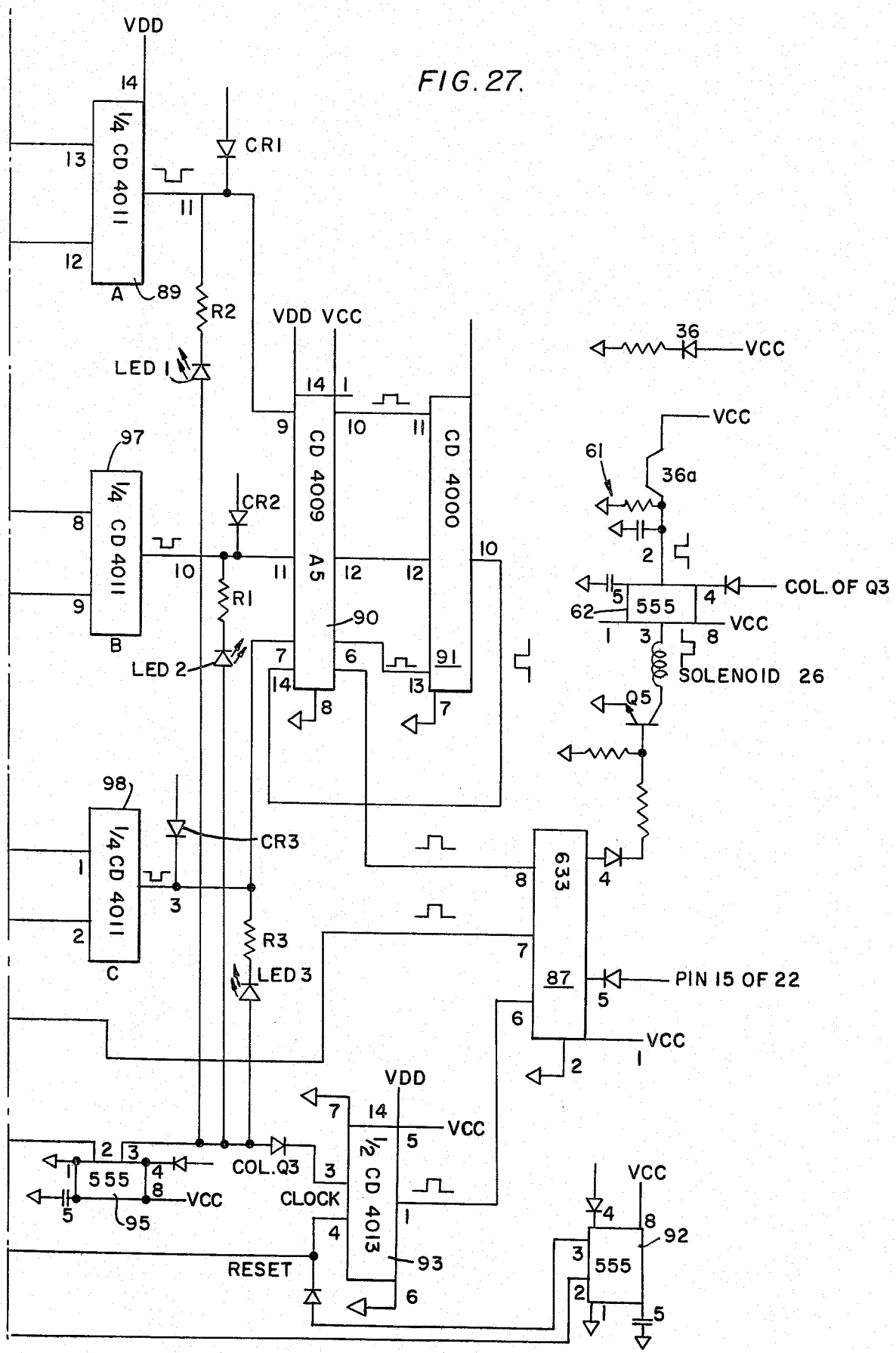

Referring now to FIGS. 26 and 27, a modified circuit for controlling acceptance or rejection of coins and slugs and the like includes a stepdown transformer 57, bridge rectifier 58 and line voltage regulator 59, including power transistor 60, as previously described, and in the particular embodiment shown, arranged to produce a regulated 15 volts dc for powering the circuit components.

As in the previously described form of the invention, a coin moving down the chute 19 first passes between LED 36 and phototransistor 36*a*, and if the coin has a diameter such as to block light to the phototransistor for a period of time equivalent to approximately ¾ the diameter of a dime, the RC network 61 is charged and a negative signal is applied to pin 2 of timer 62, which in turn, produces a positive signal at output pin 3, which is applied to one side of the solenoid 26. Thereafter, the coin rolls between LED 38 and phototransistor 38a, blocking the light to the phototransistor and causing a negative signal to be applied to pin 6 of exclusive NOR gate 81. At this time the output from pin 3 of 555 timer 82 is also negative, and thus a negative signal is being applied to pin 5 of NOR gate 81, with the result that a positive output is obtained therefrom and applied to the base of transistor Q4, driving the collector of the transistor negative and turning on the magnet 37. Further, substantially at the same time that the coin blocks light from LED 38 to phototransistor 38a, it blocks light from LED 39 to phototransistor 39a, and if the coin is magnetic, it is detained by the magnet 37 for a period of time sufficient to enable the RC network 83 to charge and apply a negative signal to pin 2 of the timer 82, which causes the output at pin 3 thereof to go positive, and the positive signal applied at pin 5 of NOR gate 81 along with the negative signal applied at pin 6 thereof causes the output to go negative, thereby turning off the magnet 37 and releasing the magnetic coin, which then continues to roll down the chute 19. The positive signal from pin 3 of timer 82 is also applied to the reset pins of flip-flops 84, 85 and 86, holding them in the reset position, and thus preventing the requirements of the circuit to be met for energization of solenoid 26. Accordingly, a magnetic coin cannot be accepted by the device of the invention. This positive signal is also applied to pin 7 of 633 chip 87. Moreover, if the coin is not magnetic, it will not be detained by the magnet 37, but will continue to move down the chute and will cease to block light to phototransistor 38a, whereby the negative signal would no longer be applied to pin 6 of NOR gate 81, and the magnet 37 will be turned off.

After passing the hole and magnet tests, the coin will pass LED 40 and phototransistor 40a, and assuming that the coin is a dime, it will have the proper diameter to block light to phototransistor 40a, causing it to go negative and applying a negative signal to pin 3 of inverter 88, which inverts the signal and applies a positive signal from pin 2 thereof to the clock pin 3 of dual flip-flop 84, setting the flip-flop and producing a positive signal at the Q-pin 1 thereof, which positive signal is applied to pin 13 of NAND gate 89. Anything smaller in diameter than a dime will not block light to phototransistor 40a,- and there is, therefore, no signal change to the inverter 88.

Next, the dime passes LED 41 and phototransitor 41a, but it does not have a diameter sufficient to block the light to phototransistor 41a and, therefore, no signal change is produced. However, if the coin should have a diameter larger than that of a dime, light is blocked to phototransistor 41a, producing a negative signal to pin 5 of inverter 88, which inverts the signal and sends a positive signal from pin 4 thereof to the reset pin 4 of flip-flop 84, resetting the flip-flop. A negative signal is then obtained from Q-pin 1 of the flip-flop.

Next, the dime rolls past LED 42 and phototransistor 42a, which are arranged to detect the thickness of the coin, and if the coin has the correct thickness for a dime, light to phototransistor 42a is blocked, producing a negative signal to pin 7 of inverter 88, which causes a positive output signal at pin 6, which signal is applied to clock pin 11 of flip-flop 84, producing a positive output at Q-pin 13 thereof, which positive output is applied to pin 12 of NAND gate 89. Inasmuch as a positive signal is now applied to both pin 12 and pin 13 of the NAND gate, a negative signal is obtained from output pin 11 thereof, and this negative signal is applied to pin 9 of inverter 90, which inverts the signal and applies a positive signal from output pin 10 thereof to pin 11 of three-input NOR gate 91. A negative signal is thus applied from pin 10 of the NOR gate 91 and this negative signal is applied to pin 14 of inverter 90 and inverted and sent through pin 6 thereof to the input pin 8 of 633 chip 87, satisfying one of the conditions of the 633 chip 87.

Next, the coin rolls past LED 43 and phototransistor 43a, and if it has the correct thickness for a dime, it does not block the light to phototransistor 43a and no signal change is produced. However, if the coin has a thickness greater than that of a dime, it does block the light to phototransistor 43a, producing a negative signal to pin 9 of inverter 88, and the signal is inverted, producing a positive signal at pin 10 thereof, which is supplied to reset pin 4 of flip-flop 84, resetting that half of the flip-flop and causing the Q-1 output thereof to go negative. This, of course, also changes the signal from NAND gate 89 and through the inverter 90 and NOR gate 91 to the 633 chip 87, with the result that the condition is no longer met at pin 8 of chip 87.

Next, the dime rolls past LED 44 and its associated phototransistor 44a, which are arranged to detect the presence of serrations on the periphery of the coin, and if serrations are present, the light is broken up and not enough reflection is received by phototransistor 44a to cause the signal thereof to change. However, if the coin does not have any serrations or, in other words, if the edge thereof is smooth, then reflected light is received by phototransistor 44a, causing it to go positive, and applying a positive signal to reset pin 4 of flip-flop 84, resetting the flip-flop. Thus, no output can be obtained from pin 1 of flip-flop 84, even though the dime may satisfy other conditions as it continues to roll down the chute.

After the serration test, the coin rolls past LED 45 and phototransistor 45a, which are arranged to detect the type or acceptability of a lip on the coin, and if the coin has a lip of proper dimensions, as on U.S. coins, light is not reflected to phototransistor 45a and there is thus no signal change. However, if a lip is present which is larger or different than that found on U.S. coins, light is reflected to phototransistor 45a, causing it to go positive and applying a positive signal to the base of transistor Q6, the collector of which then goes negative, applying a negative signal to the pin 2 of timer 92, producing a positive output at pin 3 thereof, which is applied to the reset pin 4 of flip-flop 93. Thus with the flip-flop 93 inhibited, or held in the reset position, the other condition of 633 chip 87 cannot be met, and the coin will be rejected.

Following the lip test, the coin moves past LED 46 and phototransistor 46a, which as previously described, are arranged to detect the presence or absence of indentations on the side or face of the coin which are wider and deeper than those present on U.S. coins, and if the indentations are wider and deeper than on U.S. coins, a reflection is obtained to phototransistor 46a, which causes it to produce a positive signal to the base of the transistor Q2, making the collector of the transistor go negative and applying a negative signal to pin 2 of 555 timer 94. A positive output or signal is thus obtained from pin 3 of timer 94, and this positive signal is applied to the reset pin 4 of flip-flop 93, with the result described immediately above. On the other hand, if the indentations are not wider and deeper than on valid U.S. coins, light is not reflected to phototransistor 46a in an amount sufficient to effect a signal change.

Next, the coin passes LED 47 and phototransistor 47a, which are arranged to obtain reflection of light from the side of a coin having the proper indentations therein for U.S. coins, and such reflected light causes phototransistor 47a to produce a positive signal on the base of transistor Q1, which makes the collector of the transistor go negative, turning on 555 timer 95 and obtaining a positive output from pin 3 thereof, which is supplied to clock input pin 3 of flip-flop 93, obtaining in turn a positive output from Q-pin 1 thereof, which is supplied to pin 6 of 633 chip 87, and under these conditions, a positive signal is obtained from pin 4 of 633 chip 87, which positive signal is applied to the base of transistor Q5, driving the collector thereof negative and energizing the solenoid 26 to move the coin deflect lever to accept the coin.

As the coin moves to the area of the deflector, it blocks light from LED 48 to phototransistor 48a, causing a negative signal to pin 14 of inverter 96, which inverts the signal and a positive signal is thus obtained from pin 15 thereof, which positive signal is supplied to the base of transistor Q3, causing the collector to go negative, and this negative signal is sent to pin 4 of all of the 555 timers, resetting them. This positive signal is also supplied to the reset pins of flip-flops 84, 85 and 86, resetting them. Thus the circuit is returned to the ready state for acceptance of a succeeding coin fed to the chute 19.

A nickel rolling down the chute produces similar results to that obtained with a dime, as described hereinabove, and is subjected to the hole test and magnetic test as previously described. The nickel will also interrupt light from LEDs 40, 41, 42 and 43 to their associated phototransistors, turning the flip-flop 84 on and off as the nickel advances down the chute. The nickel then passes between LED 49 and phototransistors 49a, and if it has a diameter at least as great as that of a nickel, it blocks light to the phototransistor 49a, producing a negative signal to pin 11 of inverter 88, which in turn inverts the signal and a positive signal is obtained from pin 12 thereof, which signal is applied to the clock pin 3 of flip-flop 85, obtaining a positive signal from Q output pin 1 thereof to the input pin 8 of NAND gate 97.

The nickel next passes LED 50 and phototransistor 50a, and if it does not have a diameter greater than that of a nickel, no signal change is produced. However, if the coin has a diameter greater than that of a nickel, it blocks light to the phototransistor 50a, producing a negative signal to pin 14 of inverter 88, which inverts the signal and applies it through pin 15 to reset pin 4 of flip-flop 85, resetting the flip-flop and obtaining a negative signal from the output pin 1 thereof.

Next, the nickel passes LED 51 and phototransistor 51a, which tests the thickness of a nickel, and if the nickel has the correct thickness, it blocks the light to phototransistor 51a, applying a negative signal to pin 3 of inverter 96, which inverts the signal, obtaining a positive output at pin 2 thereof, which is applied to the clock input pin 11 of flip-flop 85. A positive signal is then obtained from output pin 13 thereof, and this positive signal is applied to pin 9 of NAND gate 97. Inasmuch as a positive signal is now applied to both pins 8 and 9 of NAND gate 97, a negative signal is obtained from pin 10 thereof, and this negative signal is applied to pin 11 of inverter 90, which inverts the signal, and a positive output is obtained from pin 12 thereof, which is supplied to pin 12 of three-input NOR gate 91, which then produces a negative signal from pin 10 thereof, and this signal is supplied back to pin 14 of inverter 90 in a manner as previously described for a dime, which signal is ultimately applied as a positive signal to pin 8 of 633 chip 87, satisfying one of the conditions of that chip.

The coin also passes LED 52 and phototransistor 52a, and if it does not have a greater thickness than that of a nickel, it will not block the light to phototransistor 52a and no signal change is produced. However, if it does have a thickness greater than that of a nickel, it blocks the light and a negative signal is produced to pin 5 of inverter 96, which inverts the signal and obtains a positive output at pin 4 thereof, which signal is applied to reset flip-flop 85.

The nickel then continues down the chute and is subjected to the lip test and surface configuration tests as performed on a dime, with the result that if the coin is a bona fide nickel, the conditions at pins 8 and 6 of chip 87 are met, and the solenoid 26 is energized to accept the coin.

Similar results are obtained with a quarter, which is first subjected to the hole test and magnet test as with a dime, and which will turn the dime and nickel flip-flops on and off as it progresses down the chute.

During its movement, the quarter passes beneath LED 52 and phototransistor 53a, which are arranged to detect the presence of serrations on the margin of the quarter, and if serrations are present, a reflection is obtained, which gives a high positive output from phototransistor 53a, which positive signal is applied to the clock input pin 11 of flip-flop 86, thus producing a positive signal from pin 13 thereof, which is applied to input pin 2 of NAND gate 98.

The quarter next passes beneath LED 54 and phototransistors 54a, which are arranged such that if the quarter has the proper serrations thereon, the light is broken up and not sufficient reflection is obtained to produce a signal change. However, if the coin has a smooth surface thereon, a strong reflection is obtained, causing the phototransistor 54a to go positive, applying a positive signal to reset pin 10 of flip-flop 86, resetting the flip-flop.

After the serration test, the quarter passes between LED 55 and phototransistor 55a, which are arranged to detect the thickness of the coin, and if the quarter is of the proper thickness, it blocks the light to 55a, causing it to go negative and obtaining a positive signal from pin 6 of inverter 96, which positive signal is supplied to clock input pin 3 of flip-flop 86, thereby obtaining a positive signal from Q-pin 1 thereof, and this positive signal is applied to the pin 1 of NAND gate 98. Thus, the conditions of NAND gate 98 are satisfied and a negative signal is obtained from pin 3 thereof, and this negative signal is supplied to pin 7 of inverter 90, which inverts the signal and supplies it to pin 13 of NOR gate 91, ultimately satisfying one of the conditions of 633 chip 87, as previously described in connection with a dime and nickel.

Thereafter, the quarter passes LED 56 and phototransistor 56a, and if it is excessively thick, it blocks the light to 56a, producing a positive signal which is supplied to the reset pins 4 and 10 of flip-flop 86. Alternatively, if the quarter is of the proper thickness, light is not blocked and no signal change is produced. The quarter is then subjected to the surface configuration tests, and lip test, as described in relation to a dime and nickel, eventually resulting in the conditions of 633 chip 87 being met, and effecting energization of solenoid 26 and acceptance of the coin.

Indicating LEDs, $LED_1$, $LED_2$ and $LED_3$, are connected across the positive output of timer 95 and the negative outputs of flip-flops 89,97 and 98, to visually indicate when a dime, nickel and quarter, respectively, are supplied to the chute 10.

Rather than $LED_1$, $LED_2$ and $LED_3$, suitable solid state relay means of the type known in the art may be connected across the outputs of timer 95 and flip-flops 89, 97 and 98, which relay means would be energized or closed upon all tests being passed by a nickel, dime or quarter, and the signal sent to conventional logic accumulator means, of the type shown, for example, in applicant's aforesaid patent application Ser. No. 569,992, to count or accumulate the value of acceptable coins fed to the device. This arrangement eliminates the need for microswitches as used in prior art coin counters or accumulators and is much faster than prior art devices. An example of one use for such an arrangement would be in a coin operated toll station, which would indicate acceptance of coins much more quickly with the present device than with prior art devices. The signal obtained as a result of all tests being successfully paased could also be used for other purposes, as desired.

Additionally, rather than using light emitting means and light sensitive means to test the thickness of coins and the like, as described herein, the coin supporting track or rail 28 could have an angled or tapered upper coin supporting surface, as shown in dot-and-dash line in FIGS. 16 and 17, for example. With this arrangement, coins of excessive thickness or thinness would fail the diameter tests performed by the light emitting and light sensitive means, due to the fact that the coin would ride higher or lower on the track than a coin of the proper thickness.

Further, conventional means maybe provided in the device responsive to the presence of change therein and operative to open the contacts of relay R1 when insufficient change is present, whereby quarters supplied to the machine will not be accepted. In other words, with the contacts of realy R1 open, the flip-flop 86 cannot be set. Similarly, a further relay R2 is connected to be operated by suitable conventional means responsive to a vending operation being performed by the device, such that when a vending operation is being performed, the contacts of relay R2 are open to prevent energization of the coin accepting circuit during the vending process.

Moreover, the sensitivity of the coin testing device may easily be adjusted by changing the resistance associated with the LEDs. In other words, in some instances it may be desirable to either increase or decrease the sensitivity of some of the tests performed in order to exclude more coins and the like or to accept additional coins and the like. For example, it is possible with the present invention to discriminate between new coins and old coins in some instances, or even to discriminate between a standard quarter and a bicentennial quarter, for example.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A coin testing device for discriminating between acceptable coins and unacceptable coins, comprising: a downwardly sloping coin feed chute having a coin infeed end and a coin discharge end; coin deflector means at the discharge end of the chute and operable between a coin reject position and a coin accept position; diameter testing means associated with the chute for testing the diameter of a coin; light emitting means and associated light sensitive means disposed along the chute after the diameter testing means and positioned opposite one another along an axis inclined to the plane of the coin in position to direct light diagonally across an edge of the coin to detect the thickness of a coin moving along the chute; said diameter testing means operatively connected to set for operation the light emitting means and associated light sensitive means; and circuit means connected with the light emitting means and light sensitive means and with the coin deflector means, and operative in response to detected thickness to operate the coin deflector means to accept coins having the proper thickness and to reject coins having improper thickness.

2. A coin testing device as in claim 1, wherein: a plurality of light emitting means and associated light sensitive means are disposed along the chute in positions to detect a plurality of different features of a coin moving along the chute, and operative to produce signals in response to the detected features; said circuit means connected with the plurality of light emitting means and light sensitive means and with the coin deflector means, and operative in response to the detected features to operate the coin deflector means to accept acceptable coins and to effect rejection of unacceptable coins, said circuit means including a plurality of timer means connected with the light sensitive means to be turned on and off by the signals produced by said light sensitive means as the different features of said coin are detected and relay means operatively connected with at least some of said timer means, such that said relay means are operated between their open and closed positions in response to turning on and off said timer means, and said coin deflector means including a solenoid connected in said circuit means for operation of said coin deflector means between its coin accept and coin reject positions, said timer means and relay means connected in said circuit with said coil means, such that the signals produced by an acceptable coin as it moves along said chute are operative to effect energization of said coil to move said coin deflecter means to a coin accept position, and said timer means and relay means connected such that the detection of a single unacceptable feature of said coin is operative to prevent energization of said coil, and thus to effect rejection of the coin possessing said unacceptable feature.

3. A coin testing device as in claim 1, wherein a plurality of light emitting means and associated light sensitive means are disposed along the chute in positions to detect a plurality of different features of a coin moving along the chute, and operative to produce signals in response to the detected features; said circuit means connected with the plurality of light emitting means and light sensitive means and with the coin deflector means, and operative in response to the detected features to operate the coin deflector means to accept acceptable coins and to effect rejection of unacceptable coins, said light sensitive means comprising phototransistors and said circuit means including a plurality of inverters connected with the phototransistors such that signals produced by the phototransistors in response to detected features of a coin moving along the chute are inverted, a plurality of flip-flops connected with the inverters to receive the inverted singlas therefrom and including clock and reset connections with the inverters, whereby the flip-flops are either set or reset, depending upon the signals produced by the phototransistors, gate means connected with the flip-flops operative to produce a signal in response to predetermined conditions being met and corresponding signals being supplied thereto from the flip-flops, and coil means connected with the gate means to be energized thereby only when a predetermined number of conditions have been met as determined by the detected features sensed by the phototransistors, said coil means being connected with said coin deflector means to operate the same to accept a coin which is operative to energize the coil.

4. A coin testing device as in claim 1, wherein the coin deflector means comprises a lever pivotally mounted between its ends and having a coin deflecting surface at one end thereof and solenoid means connected to the other end thereof to pivot said lever about said pivotal connection, to selectively move said coin deflecting surface into and out of a first position for accepting coins and a second position for rejecting coins.

5. A coin testing device as in claim 1, wherein a plurality of light emitting means and associated light sensitive means are disposed along the chute in positions to detect the diameter, peripheral edge surface configuration, side surface configuration, uninterrupted diameter, magnetic property and shape and size of a peripheral annular lip or rim of a coin moving along the chute.

6. A coin testing device for discriminating between acceptable coins and unacceptable coins, comprising: a downwardly sloping coin feed chute having a coin infeed end and a coin discharge end; coin deflector means at the discharge end of the chute and operable between a coin reject position and a coin accept position; light emitting means disposed along the chute in position to direct a beam of light angularly against the edge of a coin, and associated light sensitive means positioned to receive light from the light emitting means which is reflected from the edge of the coin and to produce a signal in response thereto, whereby a coin having proper serrations on the edge thereof will diffuse or scatter the reflected light and the light emitting means will not produce a signal, and a coin having a smooth edge surface will reflect light to the light sensitive means to produce a signal; and circuit means connected with the light emitting means and light sensitive means and with the coin deflector means, and operative in response to the detected edge surface configuration to operate the coin deflector means to accept coins having the proper serrations on the peripheral edge thereof and to reject coins and the like which do not have proper serrations on the edge thereof.

7. A coin testing device as in claim 6, wherein the coin deflector means comprises a lever pivotally mounted between its ends and having a coin deflecting surface at one end thereof and solenoid means connected to the other end thereof to pivot said lever about said pivotal connection, to selectively move said coin deflecting surface into and out of a first position for accepting coins and a second position for rejecting coins.

8. A coin testing device for discriminating between acceptable coins and unacceptable coins, comprising: a downwardly sloping coin feed chute having a coin infeed end and a coin discharge end; coin deflector means at the discharge end of the chute and operable between a coin reject position and a coin accept position; first light emitting means and associated light sensitive means disposed along the chute in position to detect the presence of a coin rolling along the chute and produce a signal in response thereto; electromagnet means disposed adjacent said light emitting means and associated light sensitive means and operatively connected with the light emitting means and light sensitive means to be energized in response to the signal produced thereby, to thus stop and detain a coin having magnetic material therein; second light emitting means and associated light sensitive means adjacent the electromagnet means to detect the presence of a coin at the electromagnet means and operative in response to the presence for a predetermined period of time of a detained coin having magnetic material therein to produce a signal; and circuit means connected with the said second light emitting means and light sensitive means and with the first light emitting means and light sensitive means and also connected with the coin deflector means, and operative in response to the signal produced by the presence for a predetermined period of time of a magnetic coin to effect rejection of such coin.

9. A coin testing device as in claim 3, wherein additional light emitting means and associated light sensitive means are disposed at one side of the chute and positioned such that the light emitting means directs light diagonally at the peripheral marginal edge of the coin whereby if the coin has an annular peripheral lip thereon of unacceptable size and shape, light is reflected to the light sensitive means to produce a signal in response to the presence of the lip having an unacceptable size or shape; and circuit means connected with the light emitting means and light sensitive means and with the coin deflector means, and operative to prevent acceptance of the coin when an unacceptable lip or rim is present.

10. A coin testing device for discriminating between acceptable coins and unacceptable coins, comprising: a downwardly sloping coin feed chute having a coin infeed end and a coin discharge end; coin deflector means at the discharge end of the chute and operable between a coin reject position and a coin accept position; first and second pairs of light emitting means and associated light sensitive means disposed at one side of the chute in spaced apart locations along the chute and positioned whereby light is reflected from the light emitting means of one of the pairs off of the side of a coin and to the associated light sensitive means to produce a first signal in response to the presence of an acceptable coin having proper indentations on the side thereof, and light is reflected from the light emitting means of the other of said pairs off of the side of a coin having wider and deeper indentations on the side thereof than are present on an acceptable coin, to produce a second signal in response thereto; and circuit means connected with the pairs of light emitting means and light sensitive means and with the coin deflector means, and operative in response to absence of the first signal and/or presence of said second signal to prevent operation of the coin deflector means and thereby reject the unacceptable coin.

11. A coin testing device as in claim 10, wherein said first and second pairs of light emitting means and light sensitive means are positioned at the same side of the chute and are located in planes angularly disposed relative to one another, such that light from the light emitting means is reflected off of the side of a coin moving along the chute to the light sensitive means to produce a signal indicative of the side surface configuration of the coin.

12. A coin testing device for discriminating between acceptable coins and unacceptable coins, comprising: a downwardly sloping coin feed chute having a coin infeed end and a coin discharge end; coin deflector means at the discharge end of the chute and operable between a coin reject position and a coin accept position; a plurality of light emitting means and associated light sensitive means disposed along the chute in positions to detect a plurality of different features of a coin moving along the chute, including light emitting means and associated light sensitive means positioned to direct light angularly across the chute and diagonally across the peripheral edge of a coin andthe like to detect the thickness of the coin and to produce a signal in response thereto; and circuit means connected with the light emitting means and light sensitive means and with the coin deflector means, and operative in response to detected features, including the detected thickness, to operate the coin deflector means to accept acceptable coins and to effect rejection of unacceptable coins.

13. A coin testing device as in claim 12, wherein the coin deflector means comprises a lever pivotally mounted between its ends and having a coin deflecting surface at one end thereof and solenoid means connected to the other end thereof to pivot said lever about said pivotal connection, to selectively move said coin deflecting surface into and out of a first position for accepting coins and a second position for rejecting coins.

* * * * *